United States Patent [19]

Nürk

[11] 4,241,478

[45] Dec. 30, 1980

[54] APPARATUS FOR SHRINKING OF TEXTILE WEBS

[75] Inventor: Siegfried Nürk, Albstadt, Fed. Rep. of Germany

[73] Assignee: SIPRA Patententwicklungs- und Beteiligungsgesellschaft mbH, Stuttgart, Fed. Rep. of Germany

[21] Appl. No.: 4,309

[22] Filed: Jan. 17, 1979

[30] Foreign Application Priority Data

Jan. 25, 1978 [DE] Fed. Rep. of Germany ..... 2803079

[51] Int. Cl.[3] ..... D06C 29/00

[52] U.S. Cl. ..... 26/18.5; 28/278

[58] Field of Search ..... 26/18.5, 18.6; 28/103, 28/278

[56] References Cited

U.S. PATENT DOCUMENTS

| | | | |
|---|---|---|---|
| 2,120,536 | 6/1938 | Woodhead | 26/18.6 |
| 3,100,925 | 8/1963 | Messinger | 26/18.6 |

FOREIGN PATENT DOCUMENTS

| | | | |
|---|---|---|---|
| 715135 | 12/1941 | Fed. Rep. of Germany | 26/18.6 |
| 1083467 | 6/1954 | France | 26/18.6 |
| 37-6450 | 6/1962 | Japan | 28/278 |
| 45-41633 | 12/1970 | Japan | 26/18.6 |

*Primary Examiner*—Robert Mackey

*Attorney, Agent, or Firm*—Michael J. Striker

[57] ABSTRACT

Apparatus for mechanically crimping and shrinking textile webs mainly comprises an elongated chamber through which the textile web is moved in a predetermined direction, at least two endless crimping grates arranged in said chamber and each including an endless link chain and a plurality of crimping plates projecting equally spaced from each other in a direction transverse to the chain from the latter and in which each endless chain is guided over a pair of guide rolls so that each chain has one run moving in the direction of movement of the web through the chamber and another run moving in the opposite direction. The apparatus includes further heating means having a heated smooth guide surface opposite said one run of each endless chain and said textile web is passed between the respective heated guide surface and the outer ends of the crimping plates on the one run. The chains on successive crimping plates are driven in opposite directions and preferably at speeds which can be steplessly adjusted.

14 Claims, 4 Drawing Figures

APPARATUS FOR SHRINKING OF TEXTILE WEBS

BACKGROUND OF THE INVENTION

The present invention relates to an apparatus for mechanical crimping of textile webs with a steaming device upstream of the crimping apparatus.

In order to hold shrinking of garments after washing or cleaning of the same within narrow limits, various chemical and/or mechanical methods for obtaining form-stable textile goods are already known. A mechanical stabilizing of textile webs is partly already obtained during bleaching, dyeing or other treatment, tensioning of the web in transverse direction and/or the guiding of the textile web in tensionless and partly also in undulating condition through a treating fluid. However, especially in knitted textile webs, there remain after such treatment longitudinally acting strains, which result, after washing of garments produced from such knitted goods without crimping treatment, in a very noticeable reduction of the dimensions of the garment in longitudinal and transverse direction.

It is therefore known to lead the textile webs, before garments are made therefrom, through a steam chamber to release the tension in the web. It is also known to press the textile webs in moist condition and to compress the same in longitudinal direction. Thereby, the mechanical crimping is however often overdone, so that during fast drying of the web the latter leaves the treating apparatus in wrinkled condition.

SUMMARY OF THE INVENTION

It is an object of the present invention to provide an apparatus for mechanical crimping of textile webs which avoids the disadvantages of known methods and apparatus of this kind.

It is a further object of the present invention to provide an apparatus for mechanical crimping of textile webs which can be built at reasonable cost, which can be operated without detrimentally affecting the environment and which produces a perfect crimping action.

With these and other objects in view, which will become apparent as the description proceeds, the apparatus according to the present invention for mechanical crimping of textile webs mainly comprises an elongated chamber in which at least one pair of driven endless crimping grates, respectively guided over reversing rolls, are arranged and each provided with a plurality of crimping plates extending equally spaced from each other transverse to the direction of movement of the grates, in which the run of each grate which moves in the direction in which the web passes through the chamber extends along a heated smooth guide wall, and in which the textile web is supplied to each grate in the region where the run of the respective grate moving in the opposite direction passes over to the run moving in the direction of the web. In this arrangement, the at least two crimping grates are arranged one behind the other in the direction of movement of the web through the elongated chamber and the two grates are driven in opposite directions.

With the apparatus of the present invention, it is possible to carry out a thermally supported mechanical crimping of the web without violently beating or squeezing the same so that also very fine goods may be treated. The web, which is pretreated with steam, is fed against the respective endless crimping grate in the region where one of the runs of the endless grate passes over to the other run and is downstream of this reversing region laid in folds between successive crimping plates, as the outer ends of the latter, which in the aforementioned reversing region are spaced further from each other than the inner ends, swing back to a smaller distance to each other, and the folded web is thereby in a substantially tensionless condition transported past the heated guide walls to be simultaneously dried. In the mentioned arrangement in which successive crimping grates are respectively driven in opposite directions, the textile web is passed, with one side thereof, by the heated wall of the first crimping grate and then, on the other side thereof passed by the heated wall of the second crimping grate so that the web is subjected to a uniform drying procedure to thereby be form-stabilized in a substantially tensionless condition.

According to the present invention, the intensity of crimping can be adjusted according to the type of the textile web to be treated by adjusting the circulating speed of each crimping grate, whereby the speed of each crimping grate may be steplessly adjusted.

The apparatus of the present invention is usable for continuous operation and may be constructed with any desired number of crimping grate pairs. The heated guide walls may be resiliently mounted and the link chains on which the crimping plates of the crimping grates are mounted, are preferably guided over tension rolls so that a perfect passage of the textile web through the apparatus, independent of the heating of the same, will be assured.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
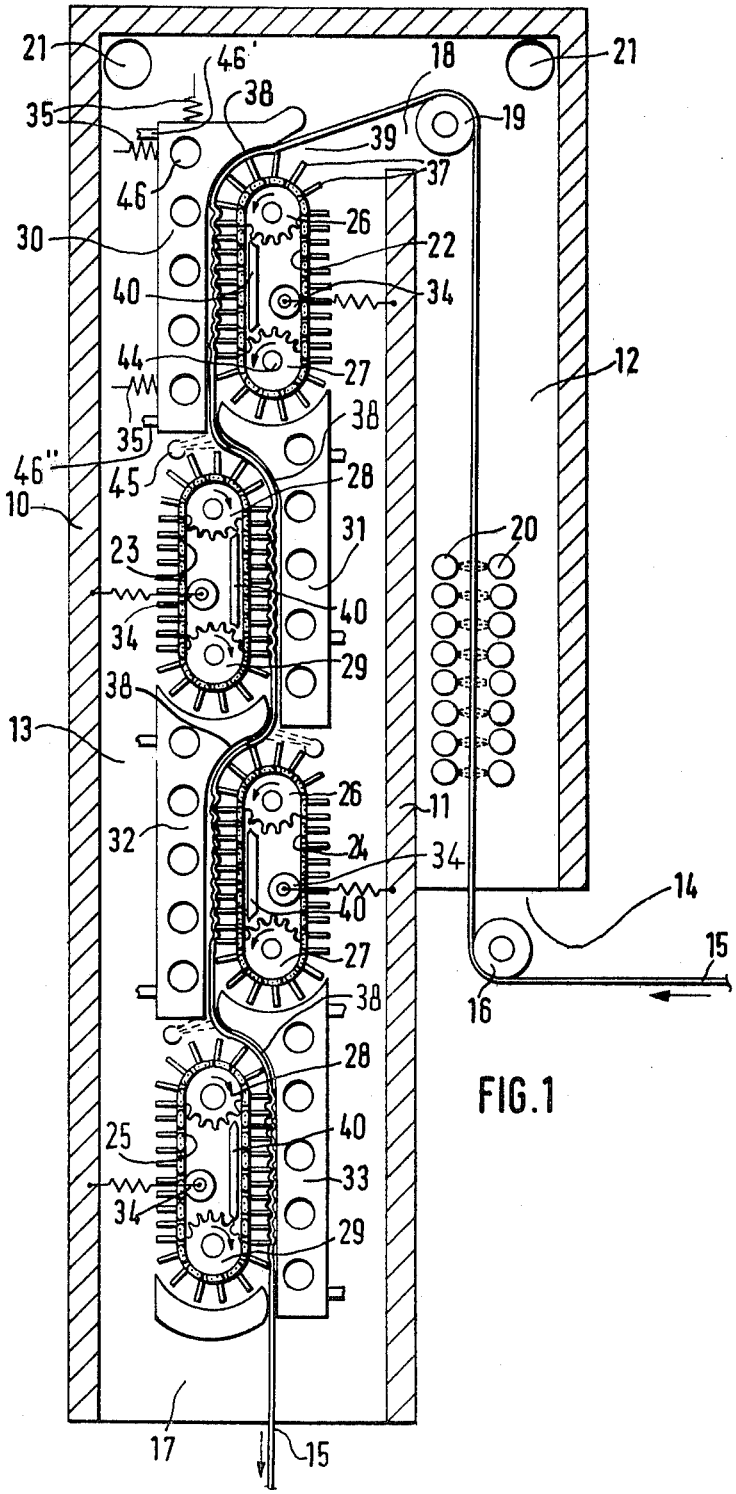
FIG. 1 is a schematic cross-section through the apparatus according to the present invention.

Referring now to the drawings, and more specifically to FIG. 1 of the same, which schematically illustrates the crimping apparatus of the present invention, it will be seen that this crimping apparatus comprises an elongated housing 10, which is divided by a middle wall 11 into a steam chamber 12 and a crimping chamber 13. The apparatus is designed for treating of textile webs 15, which are guided over a guide roll 16 adjacent the inlet opening 14 at the lower end of the steam chamber 12 into the latter, to pass upwardly therethrough and to be guided over a further guide roll 19 adjacent the top wall of the housing 10 through an opening 18 in the middle wall 11 into the crimping chamber 13 to pass downwardly in longitudinal direction therethrough and to leave finally through the outlet opening 17 at the bottom of the crimping chamber 13, to pass therefrom to a non-illustrated table or a further guiding device. In the schematic illustration of FIG. 1, the usually provided guide means in the steam chamber 12 are not shown. The textile web 15 may be a woven web or a knitted web. The textile web 15 may comprise a single layer or two layers, for instance a flattened knitted hose.

The textile web 15 is passed in the steam chamber 12 between steam nozzles 20 arranged closely adjacent to each other at opposite sides of the web 15 so that the web is intensely steamed on both sides, to thereby be wetted throughout and preheated. Steam outlet openings 21 are provided in the upper portion of the housing 10 in the steam chamber 12 as well as in the crimping chamber 13.

Two pairs of crimping grates 22, 23 and 24, 25 are arranged in the crimping chamber 13, one after the other in the direction of movement of the textile web 15 through the crimping chamber. The endless crimping grates 22, 23, 24 and 25 are respectively guided about two reversing rolls 26, 27 and 28, 29, of which one roll of each pair is driven. Heating devices 30, 31, 32 and 33 are respectively coordinated with the runs of the crimping grates 22–25 which move in the direction of the textile web 15 passing through the crimping chamber 13, whereas the other run of each crimping grate is tensioned by a spring-loaded tension roller 34.

The heating devices 30–33 are resiliently mounted, as schematically illustrated by the springs 35 at the heating device 30.

The two crimping grates of each pair are moved in opposite direction with respect to each other. Correspondingly, the runs of the crimping grates which move in the direction in which the textile web 15 passes through the crimping chamber 13 and the heating devices coordinated therewith are respectively located on opposite sides of the endless crimping grates; the construction and action thereof will be described later on in connection with FIG. 2.

Between the individual crimping grates or between the crimping grate pairs 22, 23 and 24, 25 additional vapor nozzles 45 may be arranged as shown in FIG. 1.

Figure 2:
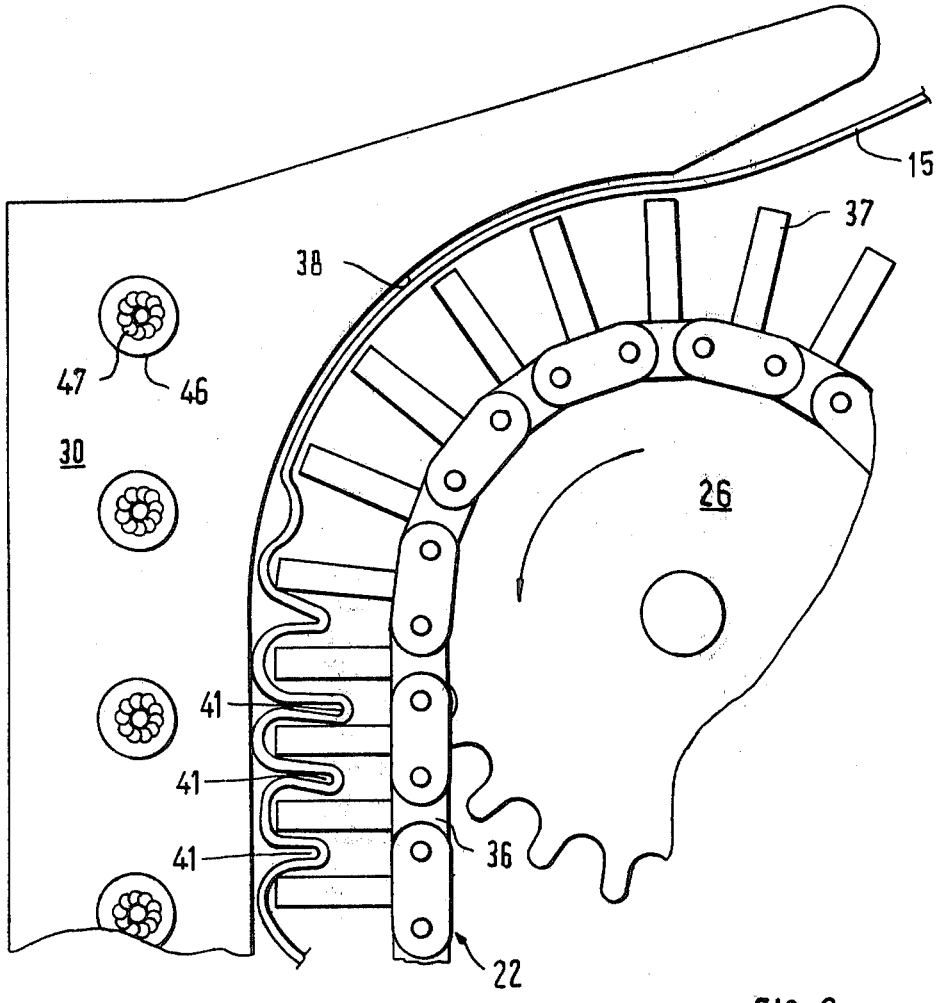
FIG. 2 illustrates on an enlarged scale part of the apparatus in the region of one of the reversing rolls of a crimping grate.

The crimping grates are preferably formed by at least two link chains 36 (FIG. 2) which are guided parallel to each other over the reversing rollers 26, 27 or 28, 29 and a plurality of crimping plates 37 of rectangular cross-section, which, extending transverse to the direction of movement of the link chain 36, are connected uniformly spaced from each other to the latter. These crimping plates 37 are preferably constructed of heat-conductive metal, but they may also form from non-metallic material. Each of the heating devices 30–33 forms with the inner wall 38 thereof a smooth guide face for the textile web 15, past which the outer ends of the crimping plates 37 move at a small distance. The heating devices 30–33 may be electrically heated or heated by steam. As schematically indicated in FIG. 1, each of the heating devices is provided with a plurality of passages 46 therethrough into which steam is fed from a steam inlet 46' and discharged through a steam outlet 46''. It is to be understood that the passages 46 schematically shown in FIG. 1 are closed at opposite ends and connected to each other so that steam from the steam inlet 46' to the steam outlet 46'' may be passed therethrough. On the other hand, each of the heating devices may be electrically heated by electrical heating coils 47, as schematically indicated in FIG. 2. The heating coils 47 may be connected in series with each other in a known manner, not shown in FIG. 2.

The textile web 15 is fed toward the respective crimping grate at the upper reversing region of the same. The feeding location of the web 15 onto the crimping grate 22 is designated in FIG. 1 with the reference numeral 39. The free ends of the crimping plates 37, connected uniformly spaced from each other to the link chains 36, are at the reversing region, due to the curvature of the reversing rolls, further spaced from each other than those of the following crimping plates which move through the straight region of the crimping grates at which the runs of the crimping grate moving in the direction of the web 15 are held by supporting members 40 parallel to each other and uniformly spaced from the heating devices 30–33. Since the free ends of the crimping plates 37 move downstream of the reversing region of each grate again toward each other, the textile web 15 engaged at the reversing region by the free ends of the crimping plates 37 is laid in folds 41 into the interstices between successive crimping plates 37, whereby in the region of the folds a certain compression of the web in longitudinal direction and in any case a relief of longitudinal tension of the textile web occurs as the latter is moved along the smooth heated surfaces 38 of the heating devices 30–33. The crimping plates 37 and the heated surfaces 38 may also be covered with a layer of Teflon.

The textile web is moved shortly before the other reversing region of the crimping grate 22 in tangential direction away from the latter and fed toward the subsequent and oppositely moving crimping grate 23 at the upper reversing region of the latter, whereby then the other side of the textile web 15 faces the coordinated heating device 31.

Figure 4:
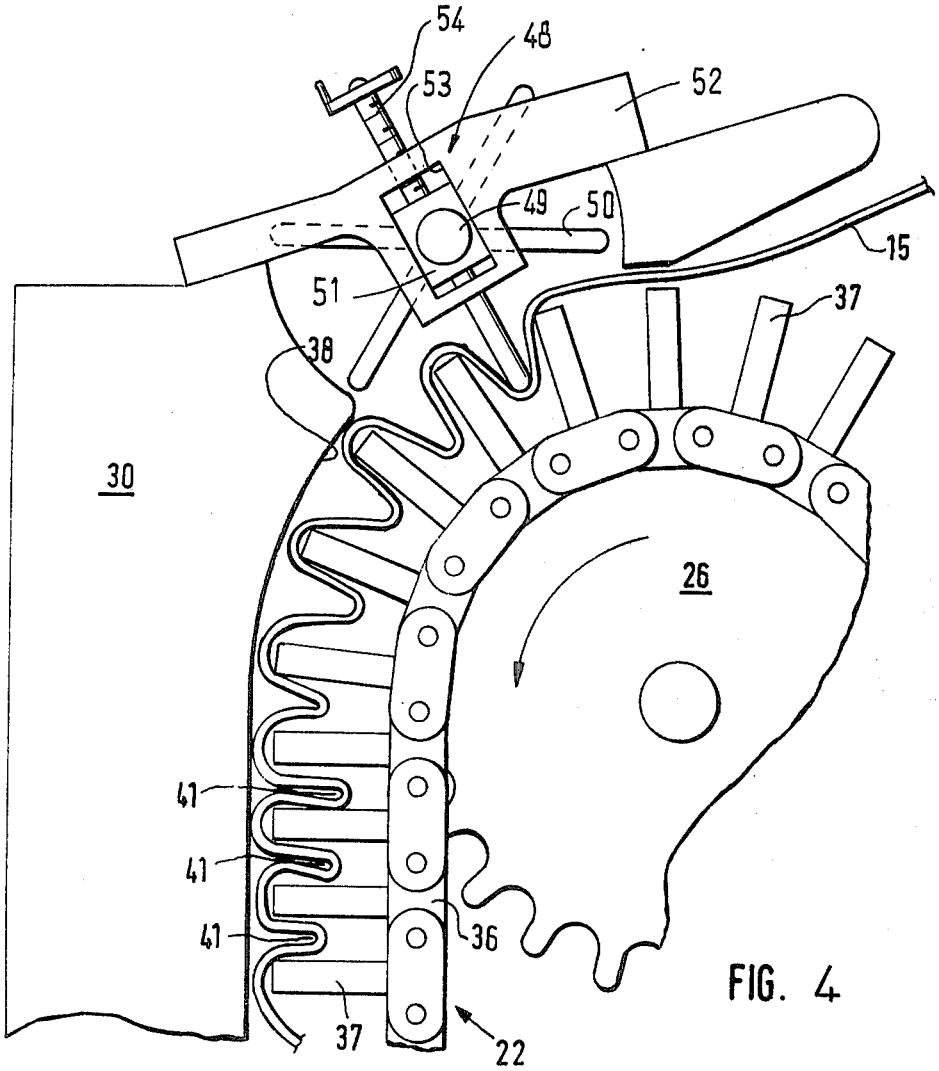
FIG. 4 is a side view similar to that shown in FIG. 2 of a modification provided with an arrangement for pushing the textile web between successive crimping plates.

It is also possible to arrange at the inlet region 39 of the textile web 15 to the crimping grates 22, 23 and 24, 25 additional star wheels 48 which mesh with the crimping plates 37, as shown in FIG. 4, and which push at the reversing region subsequent portions of the web 15 into the interstices of subsequent crimping plates 37. As shown in FIG. 4, each of the star wheels 48 has a plurality of radially extending wings 50 and a shaft 49 mounted for rotation about its axis in a bearing block 51, which in turn is mounted for movement in radial direction in a cutout 53 of a support 52 connected to the upper portion of the respective heating device and movable in this radial direction by a manually operable screw 54, to thereby adjust the depth at which the wings 50 will enter between successive crimping plates 37.

Figure 3:
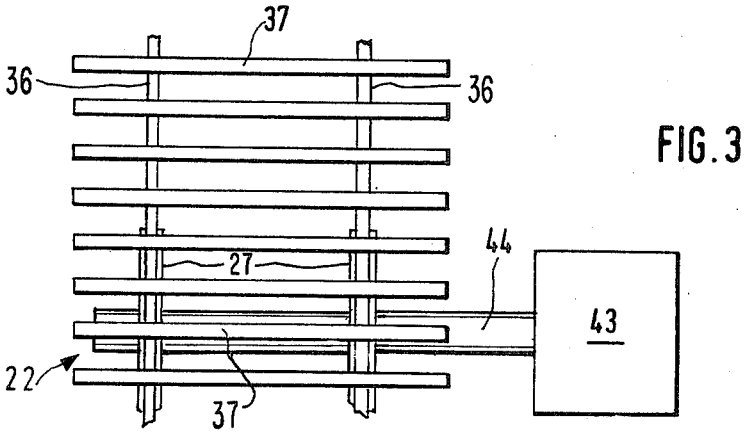
FIG. 3 is a partial top view in the region of a drive shaft for one of the grates.

As schematically illustrated in FIG. 3, the shaft 44 of the reversing roller 27 for the crimping grate 22 is driven by means of a steplessly regulatable mechanical or hydraulic drive 43 so that the speed of the crimping grate 22 may be regulated. Of course the same holds true for the other crimping grates 23–25, each of which can be driven with an individually adjustable speed.

The apparatus as schematically illustrated in FIG. 1 has a space-saving column-shaped construction. The apparatus may however also be differently constructed so that the textile web 15 passes through the crimping chamber 13 in horizontal or in inclined direction. The temperature of the heating devices 30–33 may be individually regulated so that the apparatus in connection with the stepless adjustability of the speed of the individual crimping grates 22–25 has a very wide adjustability, so as to properly adapt the operation thereof to different textile webs. No baths or chemicals are used in the operation of the apparatus according to the present invention in which the web is exclusively treated with vapor, so that the apparatus has no detrimental influence on the environment and the web passing through the apparatus may be directly fed to other devices for further acting on the thus-treated web.

It will be understood that each of the elements described above, or two or more together, may also find a useful application in other types of apparatus for mechanically crimping of textile webs differing from the types described above.

While the invention has been illustrated and described as embodied in an apparatus for mechanically crimping textile webs, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

I claim:

1. Apparatus for mechanically crimping and shrinking of a textile web, comprising means forming an elongated chamber through which the web to be crimped is passed in a predetermined direction; at least one pair of driven, endless grates extending spaced from each other in said direction and each being guided over a pair of rolls spaced in said direction from each other, each of said grates comprising plurality of crimping plates extending equally spaced from each other transverse to the direction of movement of said grates and each having an outer edge, each of said driven endless grates having one run moving in the direction of movement of the textile web and another run moving in the opposite direction; at least one pair of heating means in said chamber each having a smooth heated guide surface respectively extending closely spaced from the outer edges of the crimping plates on said one run of the respective crimping grate, the web to be crimped being guided onto the outer edges of said crimping plates in a reversing region of the runs of the respective grate to pass then through the space between the outer edges of said crimping plates and the heated guide surfaces adjacent thereto in crimped and longitudinally tensionless configuration; and means for driving the crimping grates of each pair respectively in opposite directions whereby the web is subjected to uniform heating and is form-stabilized without wrinkles in substantially tensionless condition.

2. An apparatus as defined in claim 1, wherein the drive means for each of said crimping grates are steplessly adjustable.

3. An apparatus as defined in claim 1, wherein each of said crimping grates comprises endless link chains to which the inner ends of said crimping plates are connected, and including at least one spring-loaded tensioning roll engaging the other run of the respective endless grate to tension the endless link chain.

4. An apparatus as defined in claim 3, wherein each of said crimping plates has a rectangular cross-section and is connected along one short side of the rectangular cross-section to the respective link chains.

5. An apparatus as defined in claim 1, wherein said crimping plates are formed from metal.

6. An apparatus as defined in claim 1, and including means for resiliently mounting said heating means provided with said smooth heated guide surfaces.

7. An apparatus as defined in claim 1, wherein said smooth heated guide surface for each grate extends from the point of inlet of the web at the region of reversing movement of the runs of the grate up to a point located upstream of the reversing region of the runs of the following grate.

8. An apparatus as defined in claim 1, wherein said heating means comprise electric heating coils for heating said smooth guide surfaces.

9. An apparatus as defined in claim 1, wherein said heating means are provided with a passage therethrough, and including means for passing a heated fluid through said passage for heating said smooth guide surfaces.

10. An apparatus as defined in claim 1, and including a star wheel in the region of each grate at which the one run of the grate moving in a direction opposite to said direction passes over to the run moving in said direction, said star wheel having a plurality of radially extending wings meshing with said crimping plates and pushing successive portions of said textile web into the interstices between successive crimping plates.

11. An apparatus as defined in claim 10, and including means mounting said star wheel rotatably about its axis and adjustably toward and away from the adjacent grate.

12. An apparatus as defined in claim 1, and including steam nozzles arranged between successive grates in said elongated chamber for blowing steam against the textile web.

13. An apparatus as defined in claim 1, and including a steam chamber upstream of said elongated chamber, means guiding said textile web through said steam chamber and from the latter into said elongated chamber, and a plurality of steam nozzles arranged in said steam chamber to opposite sides of the web passing therethrough for blowing steam against the web.

14. An apparatus as defined in claim 13, wherein said steam chamber extends parallel to said elongated chamber and is separated therefrom by a single wall.

* * * * *